US005938162A

United States Patent [19]

Honjo

[11] Patent Number: 5,938,162

[45] Date of Patent: Aug. 17, 1999

[54] COASTER

[76] Inventor: Osamu Honjo, 2423 E. Glendale, Glendale, Calif. 91206

[21] Appl. No.: 09/024,764

[22] Filed: Feb. 17, 1998

[51] Int. Cl.[6] ..... A47G 29/00

[52] U.S. Cl. ..... 248/346.11

[58] Field of Search ..... 248/346.11, 346.01

[56] References Cited

U.S. PATENT DOCUMENTS

| | | | |
|---|---|---|---|
| D. 357,388 | 4/1995 | Gaffin | D7/625 |
| 2,004,166 | 6/1935 | Low | 248/346.11 |
| 2,709,905 | 6/1955 | Dunlap | 248/346.11 |
| 3,195,847 | 7/1965 | Squires | 248/346.11 |
| 3,268,198 | 8/1966 | Swett | 248/346.11 |
| 3,797,796 | 3/1974 | Lansdowne | 248/346.11 |
| 4,089,498 | 5/1978 | Woodruff | 248/346.11 |
| 4,206,570 | 6/1980 | Cooper | 47/71 |
| 4,433,823 | 2/1984 | Pearson | 248/346.1 |
| 4,836,488 | 6/1989 | Ross | 248/346.11 |
| 4,858,872 | 8/1989 | Witt | 248/346.11 |
| 4,858,873 | 8/1989 | Wilmoth et al. | 248/346.11 |
| 4,953,823 | 9/1990 | Sheaffer | 248/346.1 |
| 4,958,798 | 9/1990 | Parker | 248/346.1 |
| 4,978,566 | 12/1990 | Scheurer et al. | 248/346.11 X |
| 5,018,695 | 5/1991 | Bishop | 248/346.1 |
| 5,273,182 | 12/1993 | Laybourne | 220/740 |

*Primary Examiner*—Ramon O. Ramirez
*Assistant Examiner*—Anita M. King
*Attorney, Agent, or Firm*—Goldstein & Canino

[57] ABSTRACT

A coaster, for supporting a liquid carrying vessel on furniture having a furniture surface, and protecting the furniture surface from water damage. The coaster includes a top layer that is made of a soft fibrous material and absorbs liquids. The coaster has a bottom layer that is water repellant to isolate the liquids from the furniture surface. The coaster also has a chemically impregnated water absorbent layer, which contains sodium polyacrulate or simialr product(s).

6 Claims, 1 Drawing Sheet

COASTER

BACKGROUND OF THE INVENTION

The invention relates to a coaster. More particularly, the invention relates to a mat which is placed below a vessel or container that holds water or some other liquid, for preventing damage to the surface below the vessel or container.

Although plants and fresh flowers can add considerably to any decor, they require water. However, water and furniture are generally incompatible. Even the small quantity of water that can inadvertantly drip from a vase can leave water stains, and cause costly damage to the finish of the furniture.

In addition, the most comfortable place to drink a beverage is not always the kitchen, but is often seated at the couch or in bed. Thus, coffee tables and end tables often become the resting place for our beverage containers and drinking glasses.

U.S. Pat. No. 4,433,823 to Pearson discloses a drink coaster which contains a microporous structure for absorbing liquids. U.S. Pat. No. 5,018,695 to Bishop discloses disposable coasters which contain liquid absorbing material, and thermal insulating material. U.S. Pat. No. 4,953,823 to Sheaffer et al. discloses a coaster which has two layers of absorbent material separated by spacers.

While these units may be suitable for the particular purpose employed, or for general use, they would not be as suitable for the purposes of the present invention as disclosed hereafter.

SUMMARY OF THE INVENTION

It is an object of the invention to produce a coaster which supports a liquid carrying vessel, and effectively protects a surface it is placed upon from liquid damage.

It is another object of the invention that the coaster absorbs liquid in one layer and isolates the absorbed liquid from the furniture surface with a bottom layer.

It is still another object of the invention that the coaster employs chemical means for absorbing a large qunatity of water.

The invention is a coaster, for supporting a liquid carrying vessel on furniture having a furniture surface, and protecting the furniture surface from water damage. The coaster includes a top layer that is made of a soft fibrous material and absorbs liquids. The coaster has a bottom layer that is water repellant to isolate the liquids from the furniture surface. The coaster also has a chemically impregnated water absorbent layer, which contains sodium polyacrulate.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
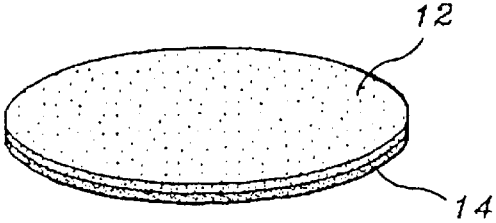
FIG. 1 is a diagrammatic perspective view, illustrating the coaster.

FIG. 1 illustrates a coaster 10, which is substantially disk-like in shape. However, a wide variety of shapes and configurations can be chosen for the coaster. In addition, the coaster can have a variety of overall colors, to match the decor where it is used. The coaster has a top surface 12, and a bottom surface 14. The coaster 10 comprises several layers, which are best illustrated in FIG. 2.

Figure 2:
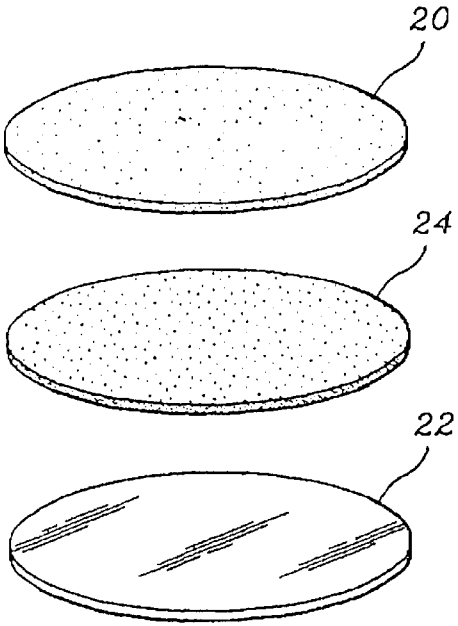
FIG. 2 is an exploded view, illustrating various layers of the coaster.

FIG. 2 is an exploded view, which illustrates the various layers of the coaster 10. The layers include a top layer 20 which is preferrably made of a soft fibrous material. The top layer 20 generally comes into contact with a vase, cup, glass, or any other vessel used to contain a liquid. Thus, the top layer 20 may be imprinted with a design, pattern, logo or the like.

The layers also include a bottom layer 22 which is water repellant. A suitable material for the bottom layer 22 is wax paper. The water repellant bottom layer isolates any water above the bottom layer 22 from the bottom surface 14 of the coaster 10. According to the present invention, a chemically impregnated water absorbent layer 24 is provided between the top layer 20 and bottom layer 22. The chemically impregnated water absorbent layer 24 comprises a carrier, and a water absorbing chemical that is impregnated within the carrier. The carrier is preferrably made of a similar material as the top layer. The chemically impregnated water absorbent layer 24 absorbs water both physically and chemically. The water absorbent layer 24 absorbs water physically by nature of the absorbent properties of the material used for the carrier. The water absorbent layer 24 absorbs water chemically, by means of the water absorbing chemical that is impregnated in the carrier. A suitable water absorbing chemical is sodium polyacrulate. The sodium polyacrulate chemically combines with the water contained within the liquid, and allows more water to be absorbed by the water absorbing layer 24 than would normally be possible, given the volume of said layer.

Figure 3:
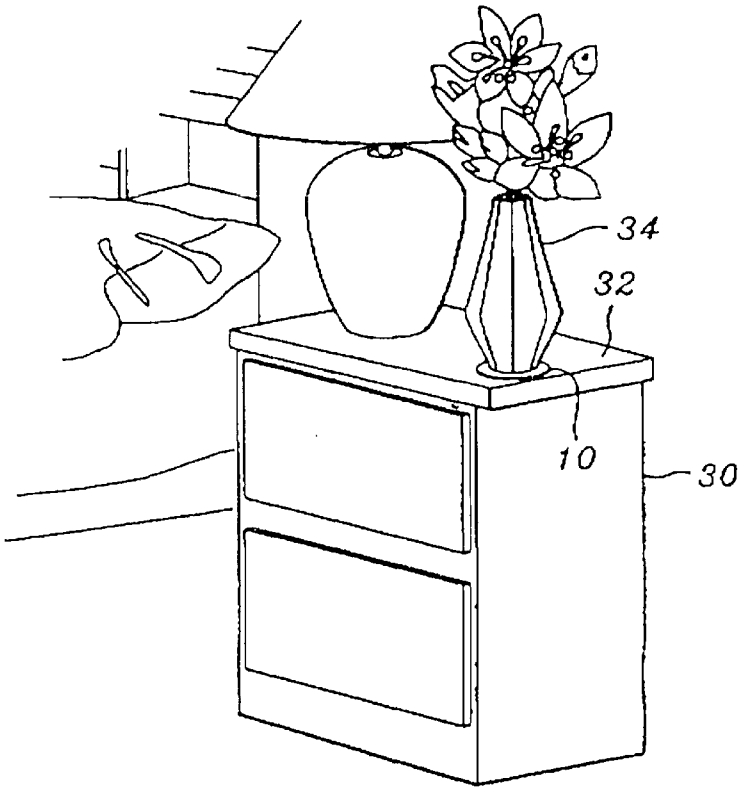
FIG. 3 is a diagrammatic perspective view, illustrating the invention in use.

FIG. 3, illustrates an article of furniture 30 having a furniture surface 32. The coaster 10 is located atop the furniture surface 32. A vessel 34, which holds a liquid, is present on top of the coaster 10. The furniture surface 32 is protected from liquid damage by the coaster 10.

In conclusion, herein is presented a coaster, for supporting a vessel, which is used to protect a furniture surface from being damaged by liquid contained within the vessel. The coaster contains physical and chemical means for absorbing water and isolating it from the furniture surface.

What is claimed is:

1. A coaster for supporting a liquid carrying vessel upon a furniture surface and protecting said furniture surface from liquid damage, comprising:

a top layer, said top layer made of an absorbent material, for contacting said vessel;

a bottom layer having a bottom surface for contacting the furniture surface, said bottom layer made of a water repellent material; and a chemically impregnated water absorbent middle layer, having a carrier and a water absorbing chemical that is impregnated within the carrier.

2. The coaster as recited in claim 1, wherein the water absorbing chemical may consist of sodium polyacrulate, or similar product(s).

3. The coaster as recited in claim 2, wherein the bottom layer is wax paper to isolate water contained in the top layer and chemically impregnated water absorbent layer from the bottom surface and thus from the furniture surface.

4. The coaster as recited in claim 3, wherein the top layer is made of a soft fibrous material.

5. The coaster as recited in claim 4, wherein the chemically impregnated water absorbent layer is located between the top layer and bottom layer.

6. The coaster as recited in claim 5, wherein the carrier is made of a soft fibrous material.

* * * * *